US005769046A

United States Patent [19]

Ransone

[11] Patent Number: 5,769,046

[45] Date of Patent: Jun. 23, 1998

[54] CARBON-CARBON CYLINDER BLOCK

[75] Inventor: Philip O. Ransone, Gloucester, Va.

[73] Assignee: The United States of America as represented by the Administrator of the National Aeronautics and Space Administration, Washington, D.C.

[21] Appl. No.: 845,652

[22] Filed: Apr. 25, 1997

Related U.S. Application Data

[63] Continuation of Ser. No. 416,599, Apr. 4, 1995, abandoned.

[51] Int. Cl.[6] ..... F02F 75/06

[52] U.S. Cl. ..... 123/193.2; 92/169.1; 92/170.1

[58] Field of Search ..... 92/169.1, 147, 92/170.1; 123/193.2, 195 R

[56] References Cited

U.S. PATENT DOCUMENTS

| | | | |
|---|---|---|---|
| 4,683,809 | 8/1987 | Taylor . | |
| 4,736,676 | 4/1988 | Taylor . | |
| 4,846,051 | 7/1989 | Wade et al. . | |
| 4,909,133 | 3/1990 | Taylor et al. . | |
| 4,955,284 | 9/1990 | Faulkner . | |
| 5,083,537 | 1/1992 | Onofrio et al. | 123/195 R |
| 5,094,150 | 3/1992 | Russner et al. . | |
| 5,370,087 | 12/1994 | Guimond et al. | 123/195 R |

FOREIGN PATENT DOCUMENTS

| | | |
|---|---|---|
| 126172 | 6/1986 | Japan . |
| 73132 | 7/1990 | Japan . |
| 252945 | 10/1990 | Japan . |

*Primary Examiner*—Thomas E. Denion
*Attorney, Agent, or Firm*—Robin W. Edwards

[57] ABSTRACT

A lightweight cylinder block composed of carbon-carbon is disclosed. The use of carbon-carbon over conventional materials, such as cast iron or aluminum, reduces the weight of the cylinder block and improves thermal efficiency of the internal combustion reciprocating engine. Due to the negligible coefficient of thermal expansion and unique strength at elevated temperatures of carbon-carbon, the piston-to-cylinder wall clearance can be small, especially when the carbon-carbon cylinder block is used in conjunction with a carbon-carbon piston. Use of the carbon-carbon cylinder block has the effect of reducing the weight of other reciprocating engine components allowing the piston to run at higher speeds and improving specific engine performance.

20 Claims, 11 Drawing Sheets

CARBON-CARBON CYLINDER BLOCK

This is a continuation of application(s) Ser. No. 08/416,599 filed on Apr. 4, 1995, now abandoned.

ORIGIN OF THE INVENTION

The invention described herein was made by employees of the United States Government and may be manufactured and used by or for the Government for governmental purposes without the payment of any royalties thereon or therefor.

BACKGROUND OF THE INVENTION

1. Field of the Invention

This invention relates generally to a cylinder block and a method of making a cylinder block for internal combustion engines, and more particularly to a carbon-carbon cylinder block that is lightweight, temperature resistant and has a low coefficient of thermal expansion.

2. Description of the Related Art

The cylinder block of internal combustion engines in automobiles is typically made of cast iron because of the need for high mechanical strength. Use of cast iron, however, adds weight to the engine and results in lower fuel economy. In an effort to reduce engine weight, various light-weight alloys such as aluminum have been used to fabricate the cylinder block. Alloys such as aluminum, however, have lower mechanical strength than cast iron and thus result in undesirable vibration. In addition, aluminum alloys have a lower temperature resistance and higher coefficient of thermal expansion than cast iron.

SUMMARY OF THE INVENTION

Carbon-carbon is of considerable interest in the fields of aeronautics and aerospace where resistance to high temperatures and thermal shocks, coupled with high strength is important. The carbon-carbon cylinder block represents a great improvement in the prior art. While performing the same function as a cast iron or aluminum alloy cylinder block, a carbon-carbon cylinder block has lower weight and negligible coefficient of thermal expansion (CTE), over 40 times smaller than that of aluminum, thereby resulting in higher dimensional stability at operating temperatures. The lower CTE of the carbon-carbon cylinder block, when used in conjunction with a carbon-carbon piston or other piston with very low CTE, results in the ability to use ringless pistons.

Accordingly an object of this invention is to reduce the cylinder block weight in an internal combustion reciprocating engine with the use of a carbon-carbon cylinder block.

It is another object of the present invention to provide a cylinder block with adequate mechanical strength during operation of the engine.

Another object of the invention is to provide a cylinder block with a low coefficient of thermal expansion, resulting in lower distortion and higher dimensional stability.

According to the present invention, the foregoing and additional objects are attained by providing a carbon-carbon cylinder block having at least one cylinder bore. The carbon-carbon block can be fabricated from a variety of multi-dimensional architectural arrangements in which the fibers are perpendicular to the axis of the cylinder bore. This fiber orientation takes advantage of the high thermal conductivity of carbon-carbon along the length of the fiber. Carbon-carbon is lightweight, temperature resistant and possesses a low coefficient of thermal expansion. Therefore, the cylinder block has greater dimensional stability and, when used with pistons having very low coefficients of thermal expansion, this stability precludes the need for piston rings and results in improved engine efficiency and lower levels of emissions due to close tolerances. Additional objects and advantages of the present invention are apparent by the drawings and specification which follow.

DETAILED DESCRIPTION OF THE INVENTION

Figure 1:
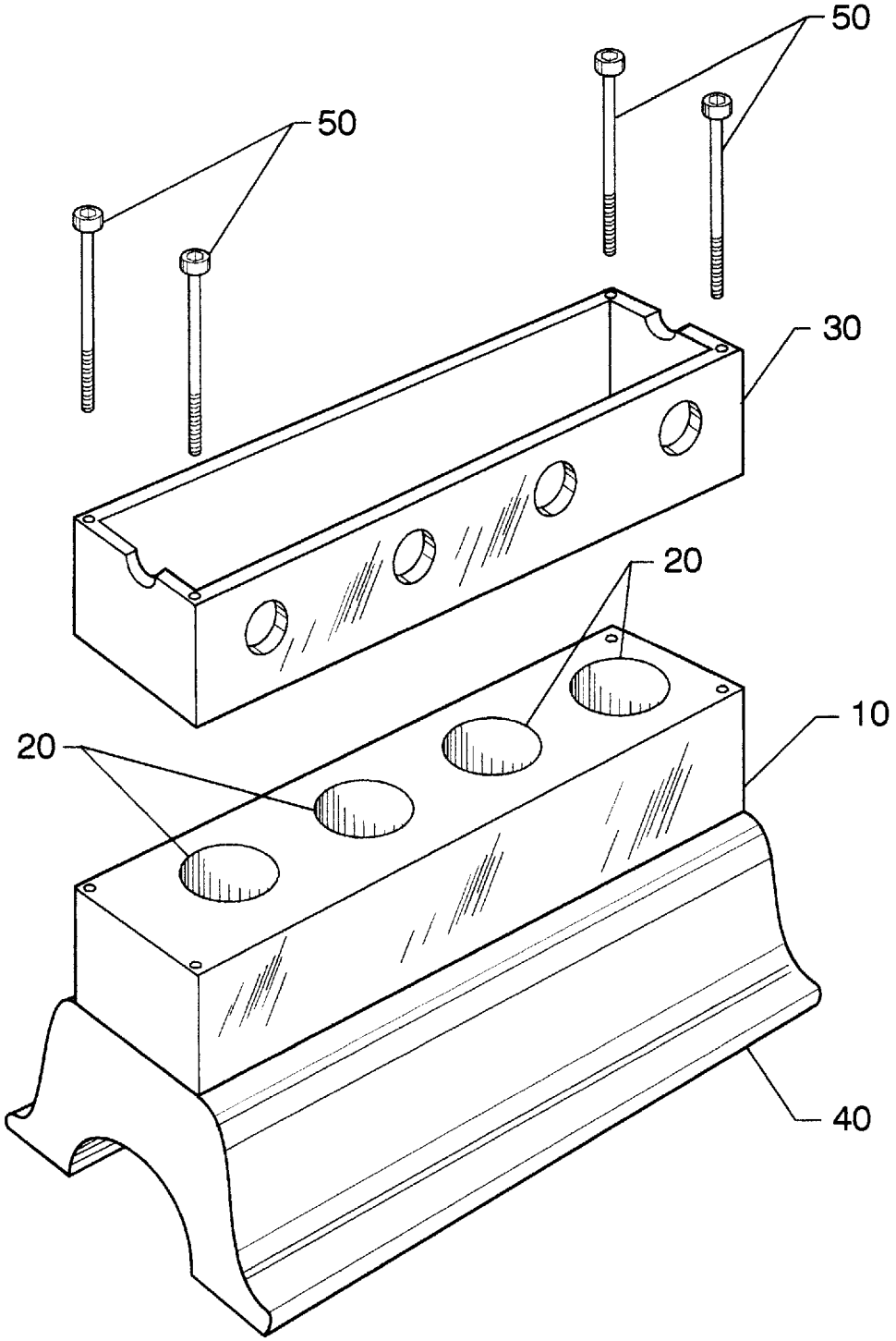
FIG. 1 is an exploded illustration of a carbon-carbon cylinder block resting between a metal crankcase and a metal engine head.
Figure 2:
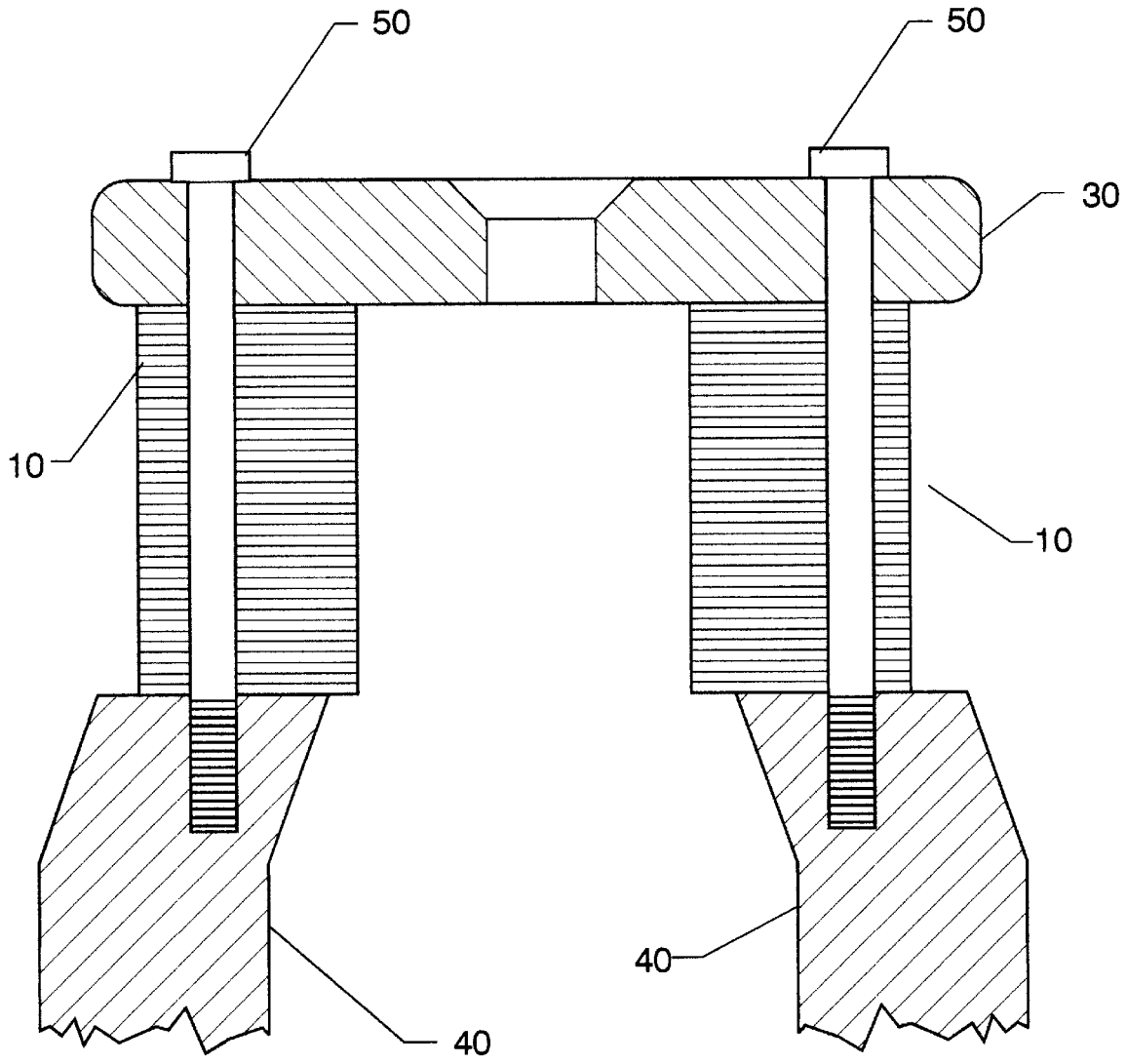
FIG. 2 is a cutaway illustration of a carbon-carbon cylinder block attached between a metal crankcase and a metal engine head.

Referring to FIGS. 1 and 2, a carbon-carbon cylinder block 10, constructed of carbon-fabric plies oriented perpendicular to the axis of the cylinder bore 20 or bores, is sandwiched between a liquid or air cooled metal head 30 and a metal crank case 40 where the assembly is held together by long head bolts 50 which pass through the head 30 and the carbon-carbon block 10. Alternatively, the bolts 50 may pass along the outside of the cylinder block 10 and thread into the metal crank case 40. The carbon-carbon block 10 can be sealed to the crank case 40 with an O-ring-type seal (not shown) and to the head 30 with an appropriately designed head gasket (not shown).

Figure 9:
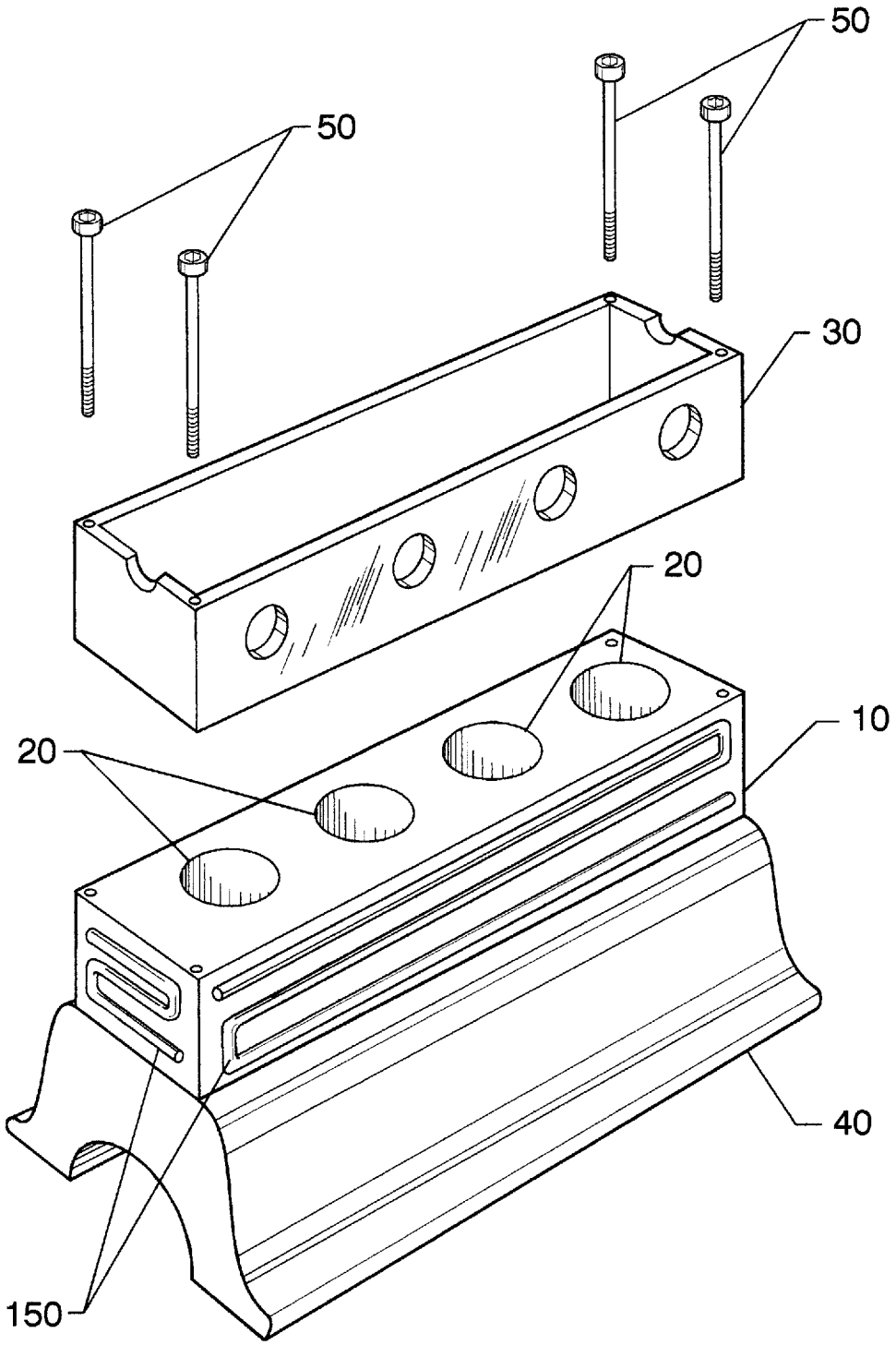
FIG. 9 illustrates a carbon-carbon cylinder block between a metal crankcase and a metal engine head. The cylinder block has metal tubes brazed thereto to circulate liquid coolant around the exterior of the cylinder block.
Figure 10:
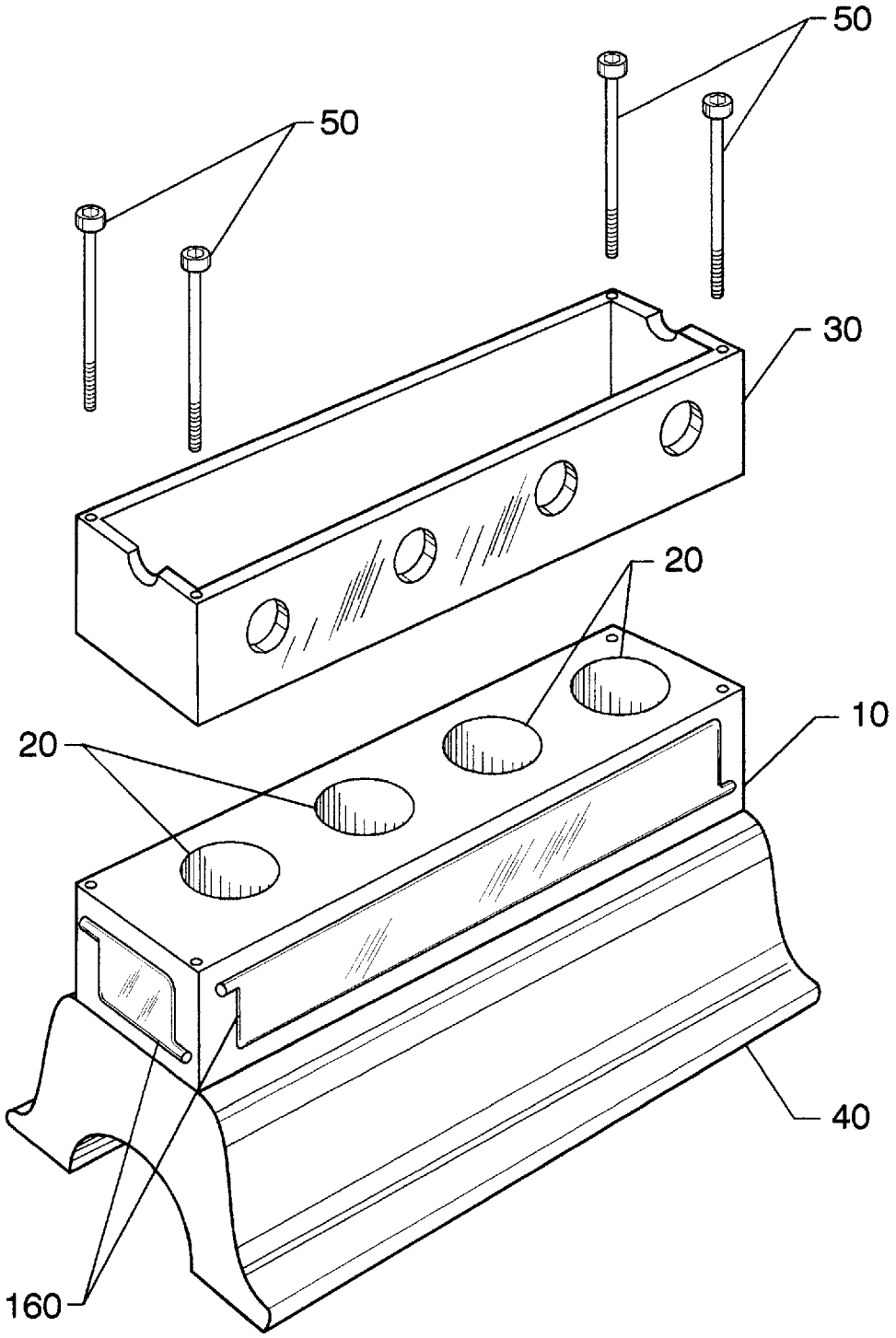
FIG. 10 illustrates a carbon-carbon cylinder block between a metal crankcase and a metal engine head. The cylinder block has metal jackets brazed thereto to circulate liquid coolant around the exterior of the cylinder block.

Since the thermal conductivity of the carbon fibers, several times greater than that of copper is possible, it is anticipated that liquid cooling passages in the automotive carbon-carbon block would not be required as the high thermal conductivity of the carbon fibers can be taken advantage of to conduct heat away from the cylinder bores to the exterior surfaces of the block where it can be disposed by convection. Metal tubes 150, as shown in FIG. 9, or jackets 160, as shown in FIG. 10, can be brazed to the exterior surfaces of the carbon-carbon block as required to circulate liquid coolant around the exterior of the block.

Figure 3:
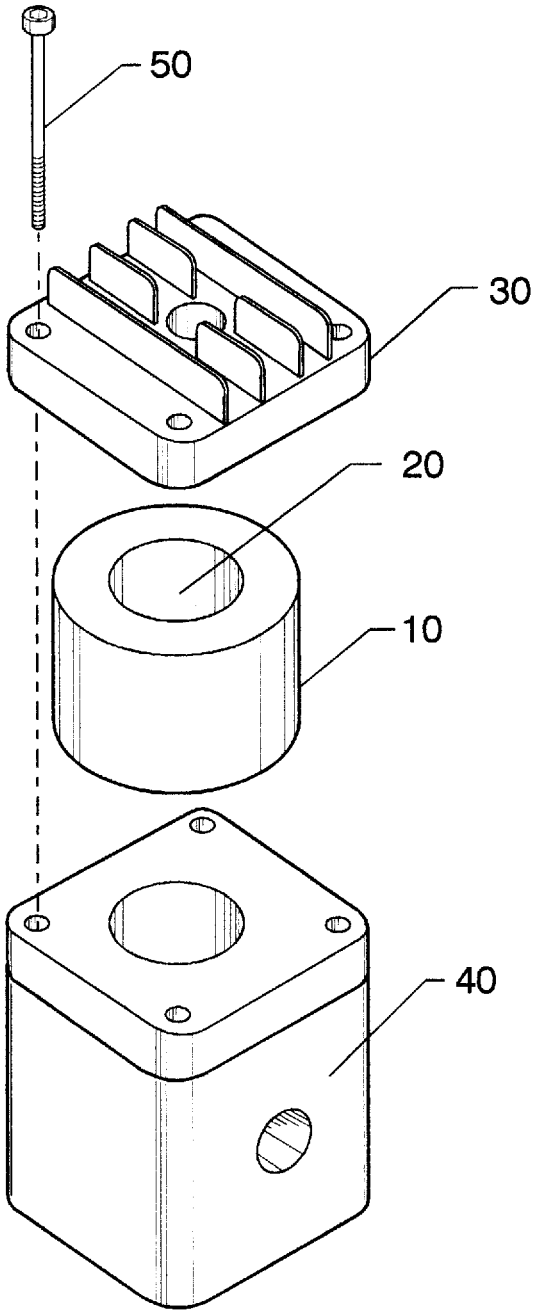
FIG. 3 is an exploded illustration of a carbon-carbon, single-bore, cylinder barrel resting between a metal crankcase and a metal engine head.
Figure 4:
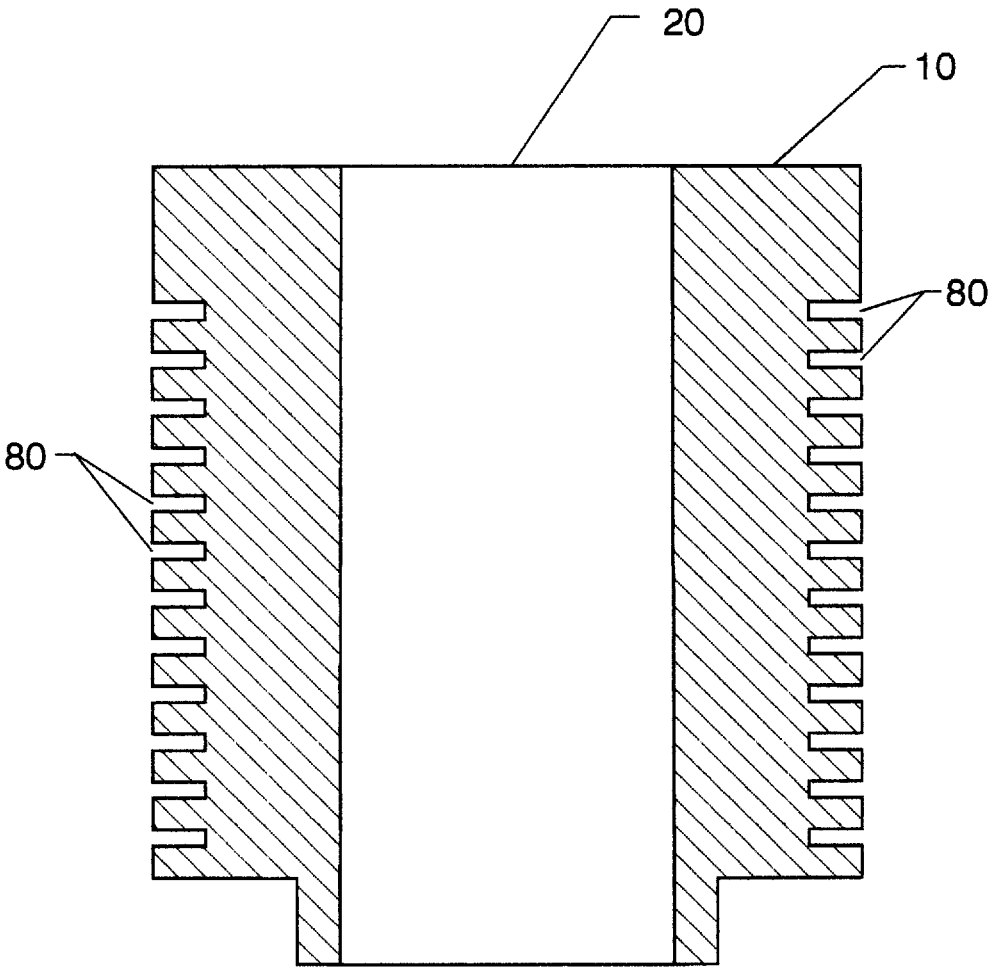
FIG. 4 is a cutaway illustration of a carbon-carbon, single-bore, cylinder head with circumferential grooves.
Figure 11:
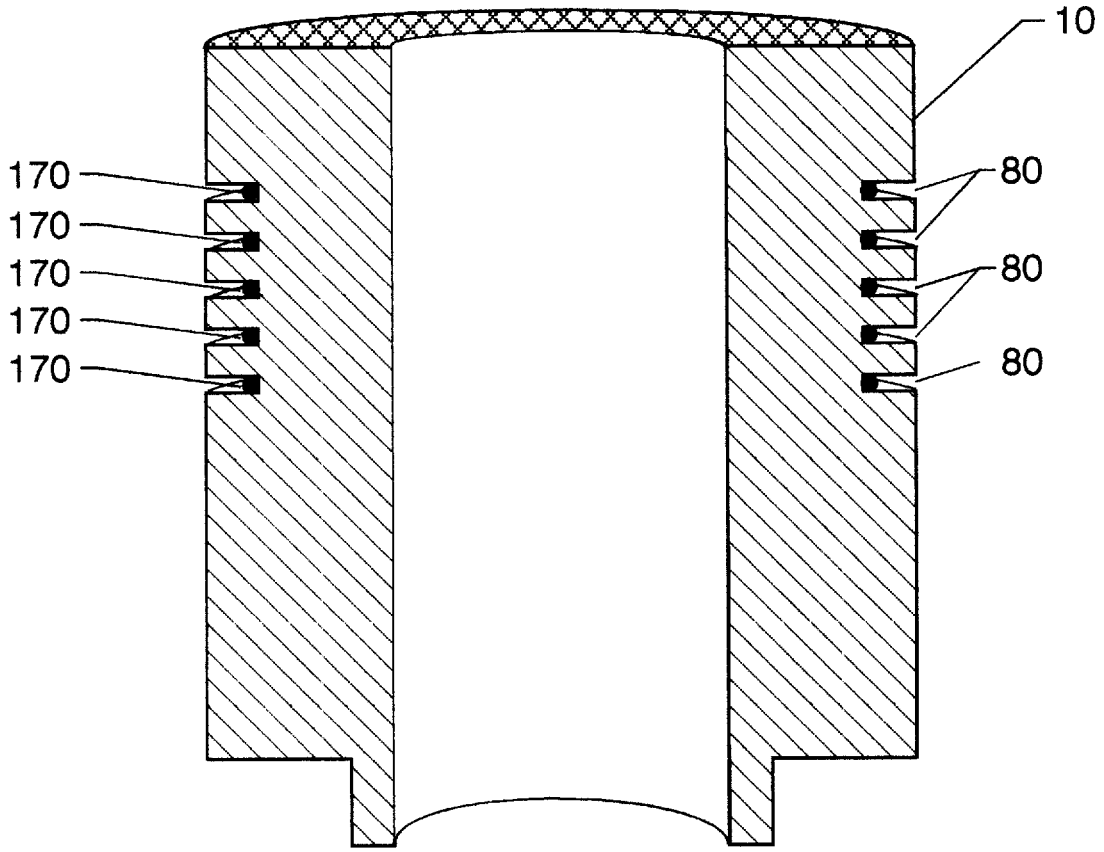
FIG. 11 is a cutaway illustration of a carbon-carbon, single-bore cylinder head with carbon fiber tows wound in circumferential grooves.

Referring to FIG. 3, for the air cooled engine where a relatively thin-walled cylinder block 10 having a single bore 20 is employed, the heat must be conducted over a much shorter distance to be dissipated to the air being forced past the block 10. Since the heat is primarily being transported along the length of the fiber, a fin arrangement will not be needed for the purpose of cooling. The side surfaces of a fin should not contribute enough to heat dissipation to be a significant cooling factor because of the relatively poor radial thermal conductivity of carbon fibers. However, as illustrated in FIG. 4 and FIG. 11, to provide structural strength, circumferential grooves 80 may be machined into the cylinder block 10 and carbon fiber tows 170 may be wound in the grooves to produce hoop strength.

In either the single or multiple bore cylinder block configuration the heat input to the cylinder walls should be lower when used with a low CTE ringless piston because of the absence of ring friction. Also, the combination of a low CTE and a higher allowable operating temperature for a carbon-carbon piston and the carbon-carbon block should make heat removal for the purposes of controlling piston temperatures and thermal distortions less critical than is the case for aluminum alloy pistons and cylinder block materials where the CTEs are relatively high.

Figure 5:
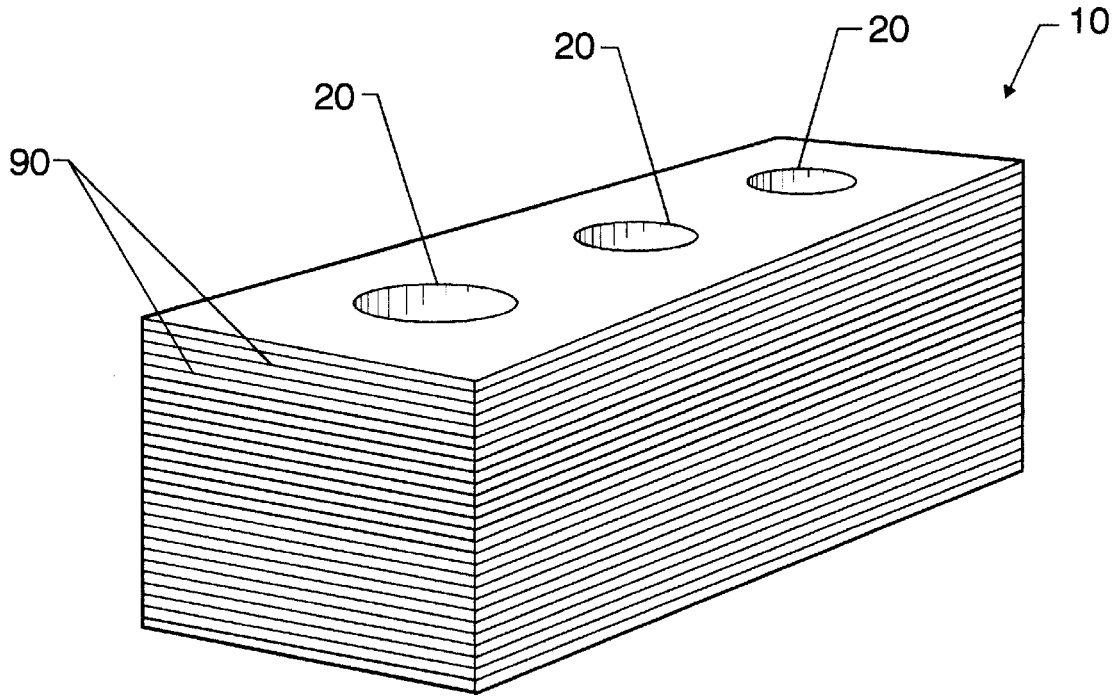
FIG. 5 is an illustration of a carbon-carbon cylinder block formed of stacked 2-D plies.
Figure 6:
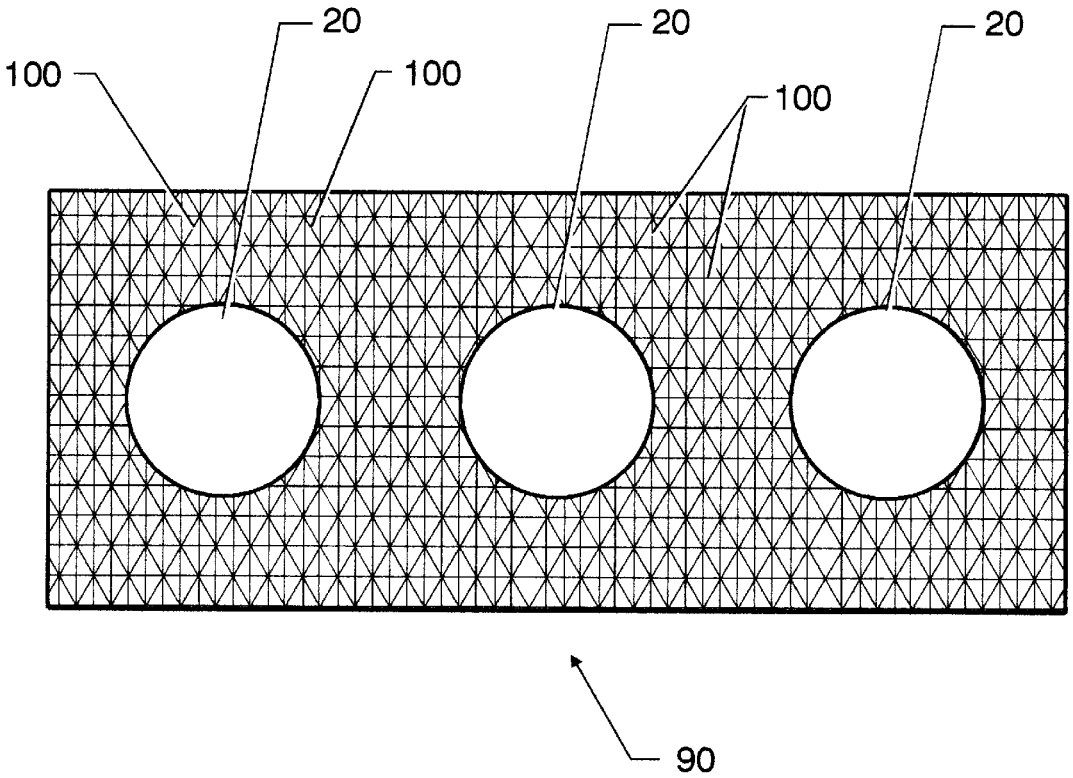
FIG. 6 is a top view of a 2-D, single ply of carbon-carbon used to fabricate a cylinder block.

There are a number of reinforcement architectural arrangements (e.g., 2-D, 3-D, . . . n-D) whereby a carbon-carbon cylinder block 10 can be constructed, however, the simplest and most economical construction is illustrated in FIGS. 5 and 6 and would consist of a stack of 2-D fabric plies 90 where all the fibers 100 are perpendicular to the axis of the cylinder bore 20. This arrangement is the basis for the close-tolerance piston-to-cylinder clearance engine. It takes maximum advantage of two very attractive features offered by carbon fibers for this application; namely, their high axial thermal conductivity and nearly zero axial thermal expansion. Maximum thermal conductivity will be normal to the cylinder bores 20 in this arrangement which should produce the most efficient cooling. The CTE of a carbon-carbon fiber is essentially zero in the axial direction but slightly higher in the radial direction. The effect of radial expansion of the fibers on pistons will be difficult to entirely avoid because low tensile strength of the composite perpendicular to the fiber directions will dictate that at least some reinforcement be in each orthogonal direction of the piston. Therefore, the piston may be subject to some diametral thermal growth.

Figure 7A:
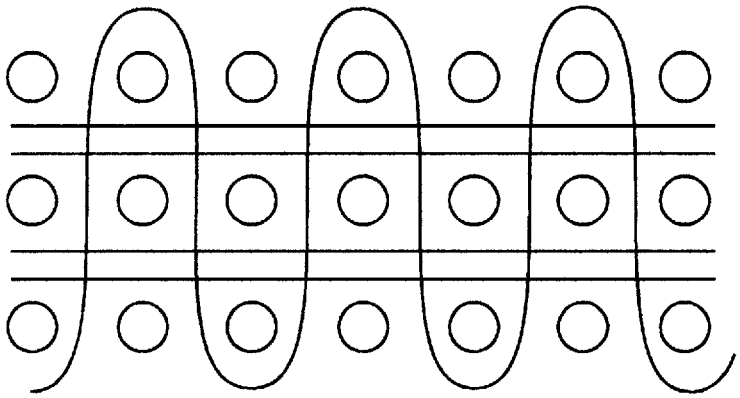
FIG. 7*a* is an illustration of a 3-D carbon-carbon fiber architecture.
Figure 7B:
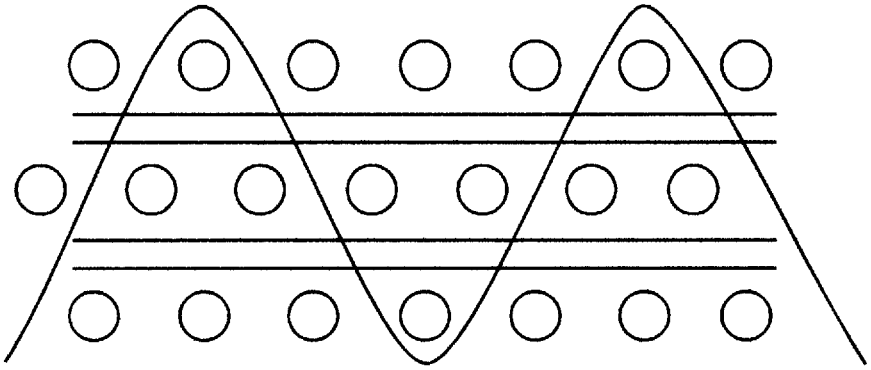
FIG. 7*b* is an illustration of another 3-D carbon-carbon fiber architecture.

To minimize this thermal growth, the use of circumferentially or axially oriented fibers should be minimized in piston designs. However, the effect of the fiber radial expansion on cylinder bore dimensions can be avoided using the preferred 2-D arrangement to construct the block. If a significant fraction of fibers were in the z-direction of the composite containing the cylinder bore or were circumferential to the surface of the bore, thermal growth of the composite could result in a decrease in the bore diameter. Additional clearance between the piston and cylinder would be required to accommodate this dimensional change. Use of the preferred 2-D arrangement will insure that dimensional changes in the bore due to thermal effects will be absolutely minimized. If growth of the bore diameter should occur as a result of the fact that carbon fibers have a slightly negative axial CTE at temperatures falling within the range of engine operating temperatures, this can be offset by adding fibers in the axial direction of the piston to cause the desired thermal growth of the piston diameter. Holding the clearances between the piston and cylinder wall to the absolute minimum is essential to success of the ringless piston engine and the described reinforcement architecture offers the most potential for achieving this goal. The inherently low interlaminar strength of a carbon-carbon block of this architecture is not a major concern, because the clamping force of the head bolts would negate cross-ply tensile stresses in the laminate. Although the stacked 2-D ply arrangement is preferred, other multi-dimensional fiber arrangements can be used, such as the 3-D fiber arrangements illustrated in FIGS. 7*a* and 7*b*.

Figure 8:
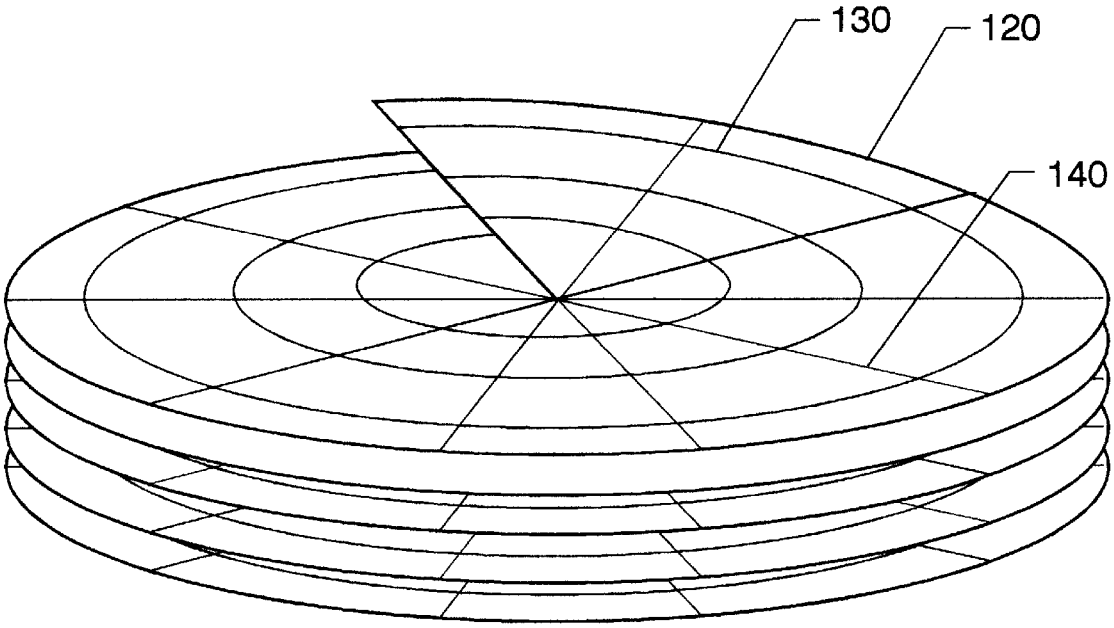
FIG. 8 is an illustration of an uncompressed polar weave fabric for fabricating single-bore, cylinder blocks.

For the single bore cylinder block 10 as illustrated in FIG. 3, a laminated polar weave architecture, as illustrated in FIG. 8, with a spiral laminate 120 having radial 140 and circumferential 130 fiber tows may be used to increase hoop strength. In addition, for the case of the single-bore cylinder block 10 as illustrated in FIG. 3, a reinforcement architecture may be used in which most of the fibers are oriented parallel and circumferential to the bore axis. This is possible because heat moves across a much shorter distance than in the cylinder block illustrated in FIG. 1. Such architecture can be produced by rolling 2-D fabric into a tube and molding or by molding a 3-D braided tube or by building up layers of 2-D braided tubes and molding.

To make a carbon-carbon composite engine block, carbon fibers are selected having the desired properties such as fiber thermal conductivity and desired strength and modulus. Fiber tows are then woven into 2-D fabrics or 3-D preforms, such as 2-D orthogonal, triaxial, or polar weaves or 3-D orthogonal weaves, angled interlock weaves or needled felts. The carbon preforms or fiber fabrics are heat treated as required to condition fiber surfaces and/or obtain other desired properties such as modulus or thermal conductivity. The fabrics are then prepregged with a suitable high carbon-yielding resin such as phenolic resin, which may contain carbon-based fillers to reduce shrinkage or may contain particulate or molecular additives to inhibit oxidation or enhance other properties such as thermal expansion in the finished part. The plies of prepregged 2-D carbon fabrics, which may be all of the same weave architecture or of different weave architecture, are then stacked. A carbon fiber 3-D preform of an appropriate architecture may also be used. The 2-D stack of plies is then molded and cured and the molded part is pyrolized in an inert atmosphere. The 3-D preform is infiltrated with a suitable filled or unfilled resin or pitch system, such as mesophase pitch or pitch resin mixtures, and pyrolized in an inert atmosphere. The initially carbonized part is then densified with carbon by any or a combination of available methods including resin (or pitch) reimpregnation and carbonization and chemical vapor infiltration processes using hydrocarbon gases or liquids as carbon sources. Desired thermal conductivity and other desired properties such as modulus are obtained by post-process heat treating in an inert atmosphere to temperatures of approximately 2500° C. or higher. The cylinder bores are then finish machined and oxidation-protective and/or wear-resistant coatings are applied to the cylinder walls.

To facilitate densification processing of 2-D carbon-carbon composites of such thickness, the rough cylinder bore can be molded into the barrel. The rough bores can also be molded into block or can be machined in before initial carbonization. In either case, this fabrication strategy exposes the central-most plies of the layup to the impregnating materials during the densification steps.

After machining of the cylinder bores to near final diameter, the cylinder wall surfaces are treated, using appropriate sealing/coating processes, to produce the necessary oxidation protection and desirable friction characteristics before final honing.

The schematic diagram of FIG. 1 for the liquid-cooled application depicts a 4-cylinder in-line arrangement, but any other arrangement of 1, 2, 3, . . . n cylinders (as in a V8) is envisioned. Likewise, for the air-cooled application, any arrangement of cylinders about the crankcase (as in 180° opposing or radial) is envisioned.

Many modifications, improvements and substitutions will be apparent to the skilled artisan without departing from the spirit and scope of the present invention as described in the specification and defined in the following claims.

What is claimed is:

1. A cylinder block for an internal combustion engine that comprises:

a carbon-carbon cylinder block composed of a fibrous material embedded in a carbonaceous matrix;

said fibrous material having fibers, each of said fibers having nonisotropic heat-transfer capability and a nonisotropic coefficient of thermal expansion, such that:

a) greater heat-transfer capability is realized parallel to each of said fibers than perpendicular to each of said fibers, and b) the coefficient of thermal expansion parallel to each of said fibers is less than the coefficient of thermal expansion perpendicular to each of said fibers;

said carbon-carbon cylinder block having at least one cylinder bore with a cylinder axis aligned along each cylinder bore; and a large majority of said fibers of said fibrous material being oriented in planes substantially perpendicular to the cylinder axis of each cylinder bore so that heat is conducted more efficiently away from each cylinder bore and thermal distortion effects on each cylinder bore are minimized.

2. A cylinder block for an internal combustion engine as specified in claim 1 wherein said carbon-carbon cylinder block is devoid of internal liquid cooling means.

3. A cylinder block for an internal combustion engine as specified in claim 1 that further comprises an external liquid cooling means attached to said cylinder block, to dissipate heat remotely.

4. A cylinder block for an internal combustion engine as specified in claim 1 that further comprises a clamping means for providing a force to said carbon-carbon cylinder block, the force being substantially perpendicular to the planes of said fibers, said clamping means being designed to prevent delamination of said carbon-carbon cylinder block.

5. A cylinder block for an internal combustion engine as specified in claim 4 wherein said clamping means comprises head bolts that pass through said carbon-carbon cylinder block, sandwiching said carbon-carbon cylinder block between a cylinder head and a crankcase.

6. A cylinder block for an internal combustion engine as specified in claim 4 wherein said clamping means comprises head bolts that pass outside said carbon-carbon cylinder block, sandwiching said carbon-carbon cylinder block between a cylinder head and a crankcase.

7. A cylinder block for an internal combustion engine as specified in claim 1 wherein said fibrous material is arranged in a stack of two-dimensional fabric plies oriented in planes substantially perpendicular to the cylinder axis of each cylinder bore.

8. A cylinder block for an internal combustion engine as specified in claim 4 wherein said fibrous material is arranged in a stack of two-dimensional fabric plies oriented in planes substantially perpendicular to the cylinder axis of each cylinder bore.

9. A cylinder block for an internal combustion engine as specified in claim 1 that further comprises filaments that are threaded through a portion of the planes of said fibers to produce a three-dimensional weave, the number of said filaments being small compared to the number of said fibers so that heat-transfer and thermal-expansion in said three-dimensional weave are dominated by the orientation of said fibers.

10. A cylinder block for an internal combustion engine as specified in claim 4 that further comprises filaments that are threaded through a portion of the planes of said fibers to produce a three-dimensional weave, the number of said filaments being small compared to the number of said fibers so that heat-transfer and thermal-expansion in said three-dimensional weave are dominated by the orientation of said fibers.

11. A cylinder block for an internal combustion engine as specified in claim 3 wherein said external liquid cooling means comprises metal tubes, a liquid coolant being circulated through said metal tubes.

12. A cylinder block for an internal combustion engine as specified in claim 3 wherein said external liquid cooling means comprises metal jackets, a liquid coolant being circulated through said metal jackets.

13. A cylinder block for an internal combustion engine as specified in claim 4 that further comprises an external liquid cooling means attached to said carbon-carbon cylinder block.

14. A cylinder block for an internal combustion engine as specified in claim 13 wherein said external liquid cooling means comprises metal tubes, a liquid coolant being circulated through said metal tubes.

15. A cylinder block for an internal combustion engine as specified in claim 13 wherein said external liquid cooling means comprises metal jackets, a liquid coolant being circulated through said metal jackets.

16. A cylinder block for an internal combustion engine that comprises:

a thin-walled carbon-carbon cylinder block composed of a fibrous material embedded in a carbonaceous matrix;

said fibrous material having fibers, each of said fibers having nonisotropic heat-transfer capability and a nonisotropic coefficient of thermal expansion, such that:

a) greater heat-transfer capability is realized parallel to each of said fibers than perpendicular to each of said fibers, and b) the coefficient of thermal expansion parallel to each of said fibers is less than the coefficient of thermal expansion perpendicular to each of said fibers;

said thin-walled carbon-carbon cylinder block having a single cylinder bore with a cylinder axis aligned along said cylinder bore; and a large majority of said fibers of said fibrous material being oriented in planes substantially perpendicular to the cylinder axis of the cylinder bore so that heat is conducted more efficiently away from the cylinder bore and thermal distortion effects on the cylinder bore are minimized.

17. A cylinder block for an internal combustion engine as specified in claim 16 that further comprises a clamping means for providing a force to said thin-walled carbon-carbon cylinder block, the force being substantially perpendicular to the planes of said fibers, said clamping means being designed to prevent delamination of said thin-walled carbon-carbon cylinder block.

18. A cylinder block for an internal combustion engine as specified in claim 16 wherein said thin-walled carbon-carbon cylinder block contains external circumferential grooves and carbon-fiber tows are wound in the external circumferential grooves.

19. A cylinder block for an internal combustion engine as specified in claim 17 wherein said thin-walled carbon-carbon cylinder block contains external circumferential grooves and carbon-fiber tows are wound in the external circumferential grooves.

20. A cylinder block for an internal combustion engine having a single cylinder bore with a cylinder axis aligned along the cylinder bore, said cylinder block comprising:

a thin-walled carbon-carbon cylinder block composed of a fibrous material embedded in a carbonaceous matrix, said fibrous material having fibers that are woven into a laminated polar weave with laminations substantially perpendicular to the cylinder axis; and a clamping means for providing a force to said thin-walled carbon-carbon cylinder block, the force being substantially parallel to the cylinder axis, said clamping means being designed to prevent delamination of said thin-walled carbon-carbon cylinder block.

* * * * *